US005399139A

United States Patent [19]

Malynowsky

[11] Patent Number: 5,399,139

[45] Date of Patent: Mar. 21, 1995

[54] FOOT REST WITH WALKING MOVEMENT

[76] Inventor: Harry Malynowsky, 4015 S. Woods Rd., Howell, Mich. 48843

[21] Appl. No.: 71,850

[22] Filed: Jun. 7, 1993

Related U.S. Application Data

[63] Continuation-in-part of Ser. No. 990,024, Dec. 14, 1992, Pat. No. 5,318,495.

[51] Int. Cl.[6] ..... A63B 21/04

[52] U.S. Cl. ..... 482/129; 482/121; 248/188.7; 601/35

[58] Field of Search ..... 482/77, 121, 122, 126, 482/128, 129, 130, 143, 904; 128/25 B, 48, 49, 51; 211/196, 205; 248/121, 188.7; 601/33-35

[56] References Cited

U.S. PATENT DOCUMENTS

| | | | |
|---|---|---|---|
| 618,990 | 2/1899 | Lobben | 482/904 |
| 798,114 | 8/1905 | Rosenthal . | |
| 2,183,265 | 12/1939 | Maloney . | |
| 2,274,574 | 2/1942 | Zerne . | |
| 2,296,043 | 9/1942 | McCleary | 248/121 |
| 2,918,243 | 12/1959 | Johnson et al. | 248/188.7 |
| 2,919,134 | 12/1959 | Zuro . | |
| 3,286,964 | 11/1966 | McMahan, Jr. et al. | 248/188.7 |
| 3,510,128 | 5/1970 | Richardson . | |
| 3,606,321 | 9/1971 | Macoulis | 482/122 |
| 3,724,450 | 4/1973 | Chaitin | 482/904 |
| 4,712,758 | 12/1987 | Cuschera | 248/188.7 |

FOREIGN PATENT DOCUMENTS

| | | | |
|---|---|---|---|
| 1075029 | 2/1960 | Germany | 482/129 |
| 15653 | 12/1885 | United Kingdom | 248/121 |
| 110654 | 11/1917 | United Kingdom | 211/196 |

OTHER PUBLICATIONS

Encyclopedia Britannica, vol. 11, p. 213.

*Primary Examiner*—Richard J. Apley
*Assistant Examiner*—Jeanne M. Mollo
*Attorney, Agent, or Firm*—Ian C. McLeod

[57] ABSTRACT

A device and method for activating the circulation of the lymphatic system in the legs of a user (100), is described. The device includes a T-shaped support 12 having a main shaft 14 with a cross shaft 16 mounted at the proximal end 14B and a base 18 mounted at the distal end 14A. Coil springs (26, 28) are mounted at one end to ends (26A, 28A) of the cross shaft or arm and at the other end (26B and 28B) to the supporting stirrups (30, 31) for the heel 103A of the user in a sitting position. The base is comprised of a first crossbar 18A and a second crossbar 18B which can be disassembled for shipping and storage. To activate the circulation of the lymphatic system, the heels of the user are first inserted into the supporting stirrups. Next, the user applies a downward force on the stirrups with the heels and finally, the user releases the downward force on the stirrups. The springs are constructed so that the legs of the user are moved in a vertically oscillating direction without significant exercise of the leg muscles and is particularly adapted for users who are unable to participate in normal activity due to age, illness or accident.

14 Claims, 3 Drawing Sheets

FOOT REST WITH WALKING MOVEMENT

REFERENCE TO RELATED APPLICATION

This application is a continuation-in-part of U.S. application Ser. No. 07/990,024, filed Dec. 14, 1992, now U.S. Pat. No. 5,318,495, issued Jun. 7, 1994.

BACKGROUND OF THE INVENTION (1) Field of the Invention

The present invention relates to a device for maintaining muscle activity and activating the lymphatic system particularly in a user not able to swim or walk due to illness, accident or age. In particular, the present invention relates to a device wherein a resilient means is connected to a support mechanism at one end and a stirrup at the other end. The base of the support mechanism is collapsible in order to allow compact shipping and storage. A user inserts a heel into the stirrup and in response to a brief downward force exerted by the heel in the stirrup, the resilient means oscillates up and down thereby maintaining muscle activity and activating the lymphatic system in the leg, without significantly exercising the muscles in the leg.

The lymphatic system is a system of vessels which closely parallels the blood vascular system. The lymphatic system helps maintain the proper fluid balance in the tissues and the blood by returning the blood protein and tissue fluid leaked from the blood vascular system to the blood. As a way to provide cells with nutrients, blood proteins seep out of the capillaries of the blood vascular system and into the interspacial spaces between the cells. Once the blood proteins diffuse from the capillaries of the blood vascular system into the tissue, the blood proteins are unable to be reabsorbed back into the circulatory system through the capillaries. The lymphatic system provides a method of removing the blood proteins from the spaces between the cells and transporting the blood proteins back into the circulatory system. The capillaries of the lymphatic system absorb the blood proteins from around the cells and into the lymphatic system. The blood proteins are removed through the vessels of the lymphatic system wherein the blood proteins are returned to the blood vascular system through the blood venous system. Unlike the blood vascular system which is controlled by the heart, the lymphatic system has no separate means to pump the lymph through the lymphatic system to the blood venous system. The lymph movement depends primarily on external forces such as muscular contraction, respiratory movement and gravity. Thus, to move the lymph, especially upward through the legs, the lymphatic system relies on a series of one way valves and compression of the valved lymphatic trunks by the surrounding leg muscles. Therefore, in order to keep the lymphatic fluid moving through the lymphatic system and thus remove blood proteins from around tissue cells, the muscles in a particular body area, such as the legs, must be kept active. New Encyclopedia Britannica, Vol. 11, p. 213, (1982).

By using the device of the present invention, the user is able to maintain a level of activity in the muscles of the legs for a longer period of time due to the low energy output required to operate the device. The longer the user's muscles are active, the longer the lymphatic system actively works to remove blood proteins from around the cells and through the lymphatic system. By placing only the heel of the foot within the stirrup, the user is allowing maximum activity in the legs and is allowing the device to activate the portion of the lymphatic system located in the soles of the feet. The heel of the foot contains several layers of fat which reduces the portion of the heel occupied by the lymphatic system. Thus, placing the heel in the stirrup causes little interference with the lymphatic system. The longer the lymphatic system works actively to remove blood proteins the more nutrients which flow to the cells and the more waste which is removed from around the cells and consequently the healthier the cells.

The user can also rest the heel of the foot in the stirrup without exerting a force in order to use the device as an elevated foot rest. The elevated foot rest allows the blood in the legs to flow upward out of the lower portion of the legs. The elevation of the legs helps to reduce the blood pressure in the veins of the legs thus, helping to relieve the discomfort associated with varicose veins, gout and edema.

(2) Prior Art

The prior art has described various types of exercising devices for appendages which use a resilient means attached to a stirrup or sling. The purpose of such devices is to exercise the muscles in the appendages. Illustrative of such devices are U.S. Pat. Nos. 798,114 to Rosenthal; 2,183,265 to Maloney; 2,274,574 to Zerne; 2,919,134 to Zuro; and 3,510,128 to Richardson.

Rosenthal describes an exercising device which is mounted onto a bed frame. The exercising device is comprised of elastic cords or helical springs which are attached at the upper end to the cross shaft which is attached to the bed and at the lower end to handles. The user is able to use the device either in the sitting or prone position depending on whether the arms or the legs are being exercised.

Maloney describes a bed service device which is attached to the ceiling or other support device over the bed. The device employs a system of ropes and pulleys to allow a user who is in the bed to use the ropes to position himself and also to use the slings or bars at the end of the ropes to exercise his limbs.

Zerne describes an exercising device which consists of a complicated system of rubber cords which form a set of loops and are attached at one end through a series of holes in an anchor plate to the ceiling. Depending on the particular user, certain loops are attached at the end opposite the anchor plate to slings which are intended to hold the user's arms or legs. The system is designed to be used by a person who is lying down for exercise of their arms or legs.

Zuro describes a home exercising device which consists of a main bar portion which is intended to be supported between two vertical supports such as a doorjamb. A pair of springs are attached at one end to the main bar portion and are provided with a handle at the opposite end. The main bar portion can also be held by the user while the legs of the user are positioned on the handles thus providing another form of exercise.

Richardson describes an exercising apparatus wherein the frame member is attached to a chair. The U-shaped frame extends between the arms of the chair in a generally vertical plane above the seat portion. The leg exerciser portion of the device consists of a pair of springs and stirrups. To use the device from the sitting position, the user places his feet in the stirrups and rotates his legs in a bicycle-like motion against the tension of the springs.

All the above devices are intended to be used to exercise the user's arms or legs particularly those of older people. There remains a need for a device which easily provides stimulation to the lymphatic system of the legs while not requiring the user to exercise and expend large amounts of energy.

OBJECTS

It is therefore an object of the present invention to provide a device which enables a user to provide stimulation to the lymphatic system of their legs, particularly persons who are not able to move their legs in the way which normally stimulates the lymphatic system. Further, it is an object of the present invention to provide a device which requires minimal effort to operate and yet provides the movement required to stimulate lymphatic circulation. Still further, it is an object of the present invention to provide a device which is easy to use and portable.

DETAILED DESCRIPTION OF THE PREFERRED EMBODIMENTS

Figure 1:
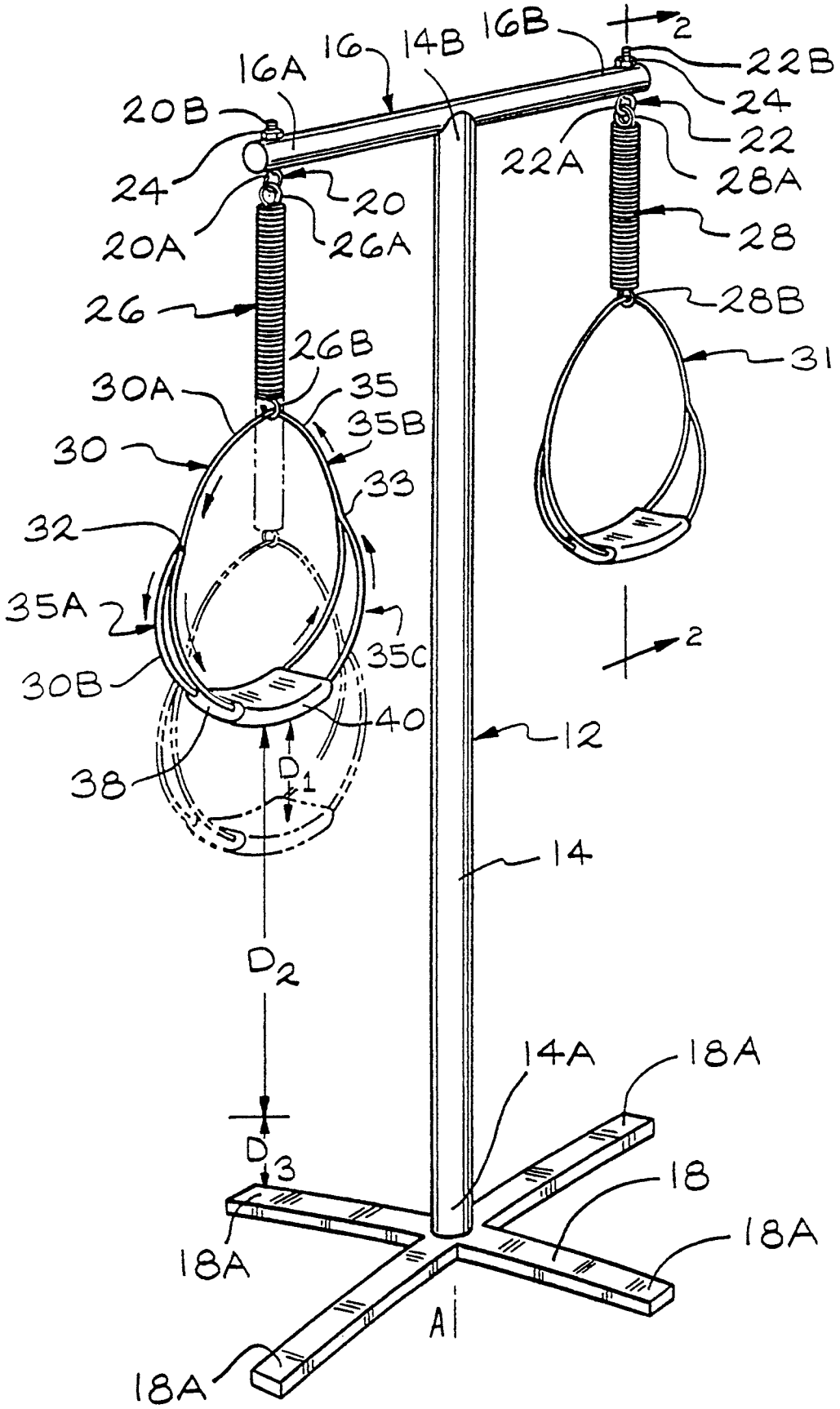
FIG. 1 is a perspective view of the lymphatic system activation device 10 showing a T-shaped support 12, the first coil spring 26 in the original and extended position and the second coil spring 28 in the original position only.

The present invention relates to a lymphatic system activation device which comprises: a support means having a main shaft defining an axis and arms extending from the axis; a pair of resilient means having a top end and a bottom end extending parallel to the axis with the top end connected to the arms support means; and a pair of stirrup means having an upper portion and a lower portion with the upper portion connected to the bottom end of each of the pair of resilient means, wherein the stirrup means and resilient means are mounted on the arms at a distance from the main shaft such that the heels of a user in a sitting position can fit into the stirrups and wherein the resilient means allows an oscillatory movement of the legs of the user to stimulate the circulation of the user without significant exercise of the muscles in the legs.

Furthermore, the present invention relates to a lymphatic system activation device which comprises: a T-shaped support means having a main shaft defining an axis, with a proximal end and a distal end, a cross shaft mounted at the proximal end of the main shaft perpendicular to the axis having a first end and a second end extending equal distance from the main shaft with a first aperture and a second aperture in the plane parallel to the axis in the first end and the second end spaced equal distance from the main shaft and a base means mounted at the distal end of the main shaft for stabilizing the T-shaped support means; a pair of mounting means, one mounted through each of the first and second apertures in the cross shaft extending downward parallel to the axis; a pair of resilient means having a top end and a bottom end with the top end connected to each of the pair of mounting means and extending downward toward the base means parallel to the axis; and a pair of stirrup means having an upper portion and a lower portion with the upper portion connected to the bottom end of each of the pair of resilient means, wherein the stirrup means and resilient means are mounted on the cross shaft at a distance from the main shaft such that the heels of a user in a sitting position can fit into the stirrups and wherein the resilient means allows an oscillatory movement of the legs of the user to stimulate the circulation of the user without significant exercise of the muscles of the legs.

The present invention also relates to a method for activating lymphatic circulation of an appendage of a user unable to maintain normal activity, which comprises: providing a support means having a main shaft defining an axis and arms extending from the axis; a pair of resilient means having a top end and a bottom end extending parallel to the axis with the top end connected to the arms support means; and a pair of stirrup means having an upper portion and a lower portion with the upper portion connected to the bottom end of each of the pair of resilient means, wherein the stirrup means and resilient means are mounted on the arms at a distance from the main shaft such that the heels of a user can fit into the stirrups and wherein the resilient means allows an oscillatory movement of the legs of the user to stimulate the circulation of the user without significant exercise of the appendage; inserting heels of the user in a sitting position in the stirrup means and resting the legs of the user adjacent the lower portion of the stirrup means; using the legs to apply a downward force on the stirrup means at the heels; releasing the downward force on the stirrup means and allowing the resilient means to pull the stirrup means and the legs upward toward an original position of the resilient means; and allowing the stirrup means and the legs to oscillate parallel to the axis in reaction to the resilience means.

The device of the present invention is portable and is used in front of a television set or the like while sitting in a chair. In addition, the base of the device is able to be disassembled which allows for compact storage and shipping of the device. By using the device, the user is provided with relief from poor lymphatic circulation in the legs.

FIGS. 1 to 6 show the preferred embodiment of the lymphatic system activation device 10 of the present invention. As shown particularly in FIG. 1, the lymphatic system activation device 10 is comprised of a T-shaped support 12, a pair of coil springs 26 and 28 and a pair of stirrups 30 and 31.

The T-shaped support 12 is formed from a main shaft 14 with a distal end 14A and a proximal end 14B, extending along the axis A—A, an arm or cross shaft 16 mounted at the proximal end 14B of the main shaft 14 perpendicular to the axis A—A and a base 18 mounted at the distal end 14A of the main shaft 14. The cross shaft 16 has a first end 16A and a second end 16B extending equal and opposite distance from the main shaft 14. The first end 16A and the second end 16B are provided with a first aperture (not shown) and a second aperture 17 in a plane parallel to the axis A—A spaced equal distances from the main shaft 14. In the preferred embodiment, both the main shaft 14 and the cross shaft 16 (FIG. 2) have a circular cross-section and are hollow. It is also preferred that the T-shaped support 12 be constructed of metal which is durable such as steel.

Figure 4:
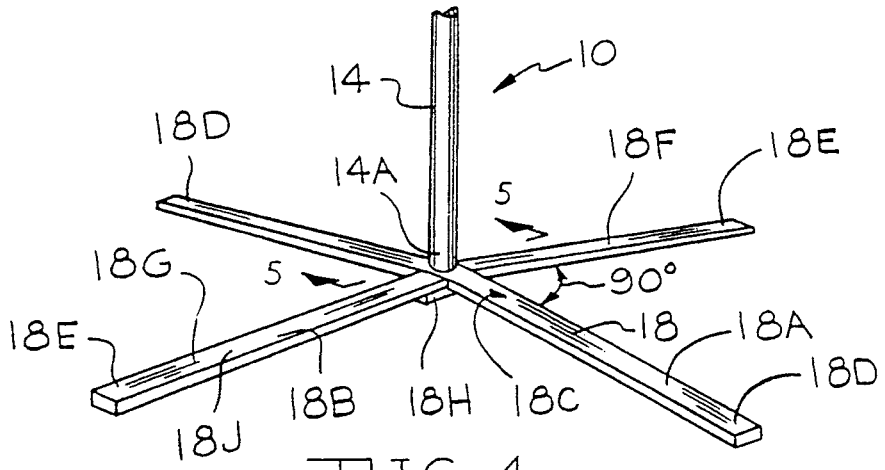
FIG. 4 is a partial perspective view of the lymphatic system activation device 10 showing the main shaft 14 attached at the distal end 14A to the base 18.
Figure 5:
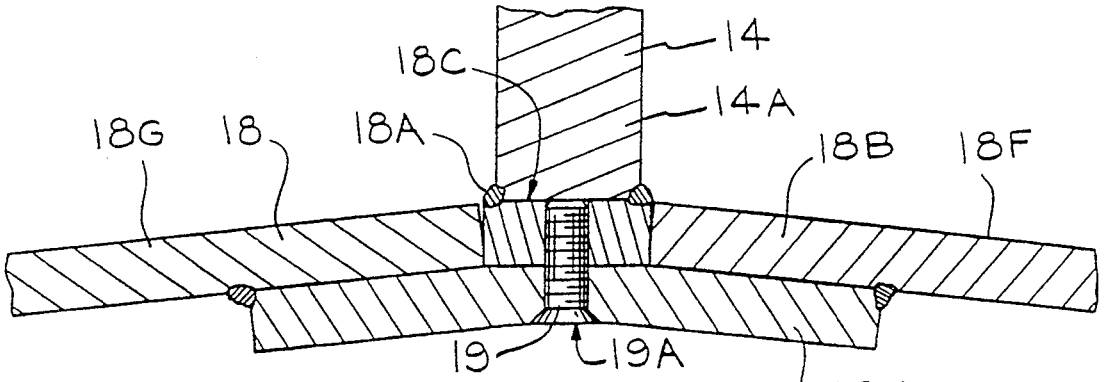
FIG. 5 is a cross-sectional enlarged view of FIG. 4 through the line 5—5 showing the first crossbar 18A, the second crossbar 18B, the support bar 18H and the attachment bolt 19.
Figure 6:
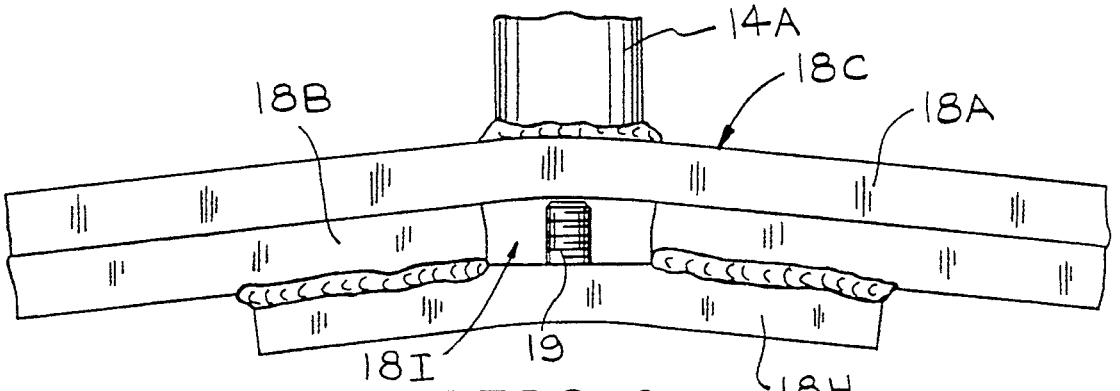
FIG. 6 is an enlarged view of the first crossbar 18A disassembled from the second crossbar 18B and positioned parallel and adjacent to the second crossbar 18B for shipping.

In the preferred embodiment as shown in FIGS. 4 to 6, the base 18 is comprised of a first crossbar 18A and a second crossbar 18B. The main shaft 14 is mounted perpendicular to the first crossbar 18A on the top side 18C of the first crossbar 18A. Preferably, the main shaft 14 is welded onto the top side 18C of the first crossbar 18A. The main shaft 14 is mounted at the center of the first crossbar 18A such that the ends 18D of the first crossbar 18A extend outward an equal distance on either side of the main shaft 14. The second crossbar 18B is attached at the center of the first crossbar 18A on the side opposite the main shaft 14. The second crossbar 18B is attached such that the ends 18D of the first crossbar 18A and the ends 18E of the second crossbar 18B are alternately spaced 90° apart around the main shaft 14 (FIG. 4). In addition, preferably the lengths of the first and second crossbars 18A and 18B are similar such that the ends 18D and 18E of the first and second crossbars 18A and 18B extend outward an equal distance from the main shaft 14. The lengths of the crossbars 18A and 18B are directly proportional to the height of the main shaft 14 and the distance of the first and second apertures 17 of the cross shaft 16 from the main shaft 14. The taller the main shaft 14 and the farther the apertures 17 are from the main shaft 14, the longer the crossbars 18A and 18B of the base 18 must be in order to provide adequate stability. For the greatest stability, the distance of the ends 18D and 18E of the crossbars 18A and 18B from the main shaft 14 should be greater than the distance of the apertures 17 of the cross shaft 16 from the main shaft 14. The ends 18D and 18E of the crossbars 18A and 18B extend outward from the main shaft 14 in a plane angled slightly downward from the plane perpendicular to the axis A—A (FIG. 1). The angling of the crossbars 18A and 18B provides additional stability to the T-shaped support 12 without increasing the length of the crossbars 18A and 18B.

As shown in FIGS. 5 and 6, the second crossbar 18B is comprised of a first end bar 18F and a second end bar 18G connected together by a support bar 18H. In the preferred embodiment, the end bars 18F and 18G are mounted to the top of the support bar 18H by welding. Preferably, the end bars 18F and 18G are similar in size and length and are attached to the support bar 18H such that a gap 18I is located at the center of the second crossbar 18B. As shown in FIG. 5, the first crossbar 18A is mounted within the gap 18I of the second crossbar 18B such that the side of the first crossbar 18A opposite the main shaft 14, is adjacent the top of the support bar 18H. An attachment bolt 19 is inserted through a hole (not shown) in the support bar 18H and extends upward into the first crossbar 18A. Preferably, the length of the attachment bolt 19 is such as to extend through the support bar 18H and extend almost completely through the first crossbar 18A. In addition, the attachment bolt 19 preferably has a flat head 19A which mounts within an indentation (not shown) in the support bar 18H such as to enable the flat head 19A of the attachment bolt 19 to be flush with the bottom surface of the support bar 18H (FIG. 5). The width of the gap 18I of the second crossbar 18B is such as to easily accommodate the width of the first crossbar 18A but not such as to allow extraneous side-to-side movement of the first crossbar 18A within the gap 18I of the second crossbar 18B. The depth of the gap 18I of the second crossbar 18B allows the top side 18C of the first crossbar 18A to be flush with the top side 18J of the second crossbar 18B which increases the aesthetic effect of the base 18. The interconnection of the first and second crossbars 18A and 18B also adds stability to the base 18 and allows the base 18 to be used without the attachment bolt 19 being inserted.

The base 18 can be easily disassembled which allows more compact shipping and storage of the device 10. During shipping or storage, the second crossbar 18B is removed from the first crossbar 18A and is situated parallel and adjacent to the side of the first crossbar 18A opposite the main shaft 14 (FIG. 6). Preferably, the main shaft 14 is mounted onto the first crossbar 18A such that the first crossbar 18A is parallel to the cross shaft 16 of the main shaft 14. By positioning the first crossbar 18A parallel to the cross shaft 16, the lymphatic system activation device 10 extends outward in only one plane when the second crossbar 18B is removed. Thus, the space needed to store the device 10 is minimized and the box size needed to ship the device 10 is also reduced.

Figure 2:
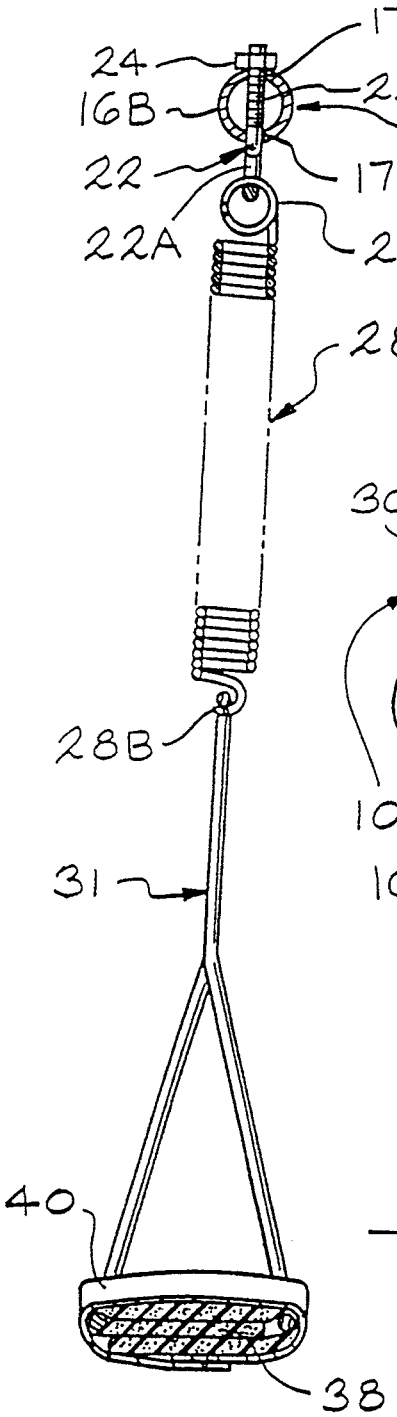
FIG. 2 is a cross-sectional view of FIG. 1 through line 2—2 showing the second coil spring 28 mounted to the second end 16B of the cross shaft 16 and the padding 38 and cover 40 of the second stirrup 31.

Mounted through each of the two apertures 17 of the cross shaft 16 is a first hook bolt 20 having a first hook portion 20A and a first bolt portion 20B and a second hook bolt 22 having a second hook portion 22A and a second bolt portion 22B. The hook bolts 20 and 22 are mounted such that the hook portions 20A and 22A extend downward parallel to the main shaft 14 toward the distal end 14A of the main shaft 14 and the bolt portions 20B and 22B extend upward through the apertures 17 (FIG. 2). The hook bolts 20 and 22 are held in place by nuts 24 mounted onto the bolt portions 20B and 22B of the hook bolts 20 and 22 adjacent the top of the cross shaft 16.

Mounted through each of the hook portions 20A and 22A of the first and second hook bolts 20 and 22 is a first coil spring 26 and a second coil spring 28. The first and second coil springs 26 and 28 each have a top end 26A and 28A and a bottom end 26B and 28B. In the preferred embodiment, the top end 26A and 28A is formed by a double circular loop while the bottom end 26B and 28B is a single loop with a small slit opening. The top end 26A and 28A of each coil spring 26 and 28 is mounted through one of the hook portions 20A and 22A of the first and second hook bolts 20 and 22 and extends downward from the first and second hook bolts 20 and 22 toward the base 18 of the T-shaped support 12 parallel to the axis A—A. Although a coil spring 26 and 28 is preferred, any other suitable elastic material can be used.

A first stirrup 30 and a second stirrup 31 is mounted at the bottom end 26B and 28B of each of the first and second coil springs 26 and 28. The first and second stirrups 30 and 31 are identical, therefore only the first stirrup 30 is described in detail. The first stirrup 30 has an upper portion 30A and a lower portion 30B which connect at a first intersection 32 and a second intersection 33. As shown in FIG. 1, the first stirrup 30 is formed by a single metal wire 35. One end of the wire 35 is located at the first intersection 32 of the upper portion 30A and the lower portion 30B and the other end of the wire 35 is located on the other side of the stirrup 30 at the second intersection 33. The formation of the stirrup 30 is symmetrical, therefore it does not matter which end of the wire 35 is chosen as the starting point for tracing the path of the wire 35 to form the stirrup 30. FIG. 1 shows with arrows one possible configuration of the wire 35.

The wire 35 of the stirrup 30 extends downward from the first intersection 32 and over to the opposite second intersection 33 forming a first downward arc 35A between the first and second intersection 32 and 33. The first downward arc 35A forms one half of the lower portion 30B of the stirrup 30. Next, the wire 35 extends upward from the second intersection 33 through the bottom end 26B of the coil spring 26 to the opposite first intersection 32 forming an upward arc 35B between the first and second intersections 32 and 33. The upward arc 35B forms the upper portion 30A of the stirrup 30 and enables the stirrup 30 to be mounted onto the coil spring 26. The height of the upward arc 35B, above the lower portion 30B of the stirrup 30, is such as to allow the user 100 to easily insert his foot 103 into the stirrup 30 and such that when the user's heel 103A rests on the lower portion 30B of the stirrup 30, the top of the user's foot 103 does not touch the top of the upper portion 30A of the stirrup 30. By placing only the heel 103A of the foot 103 on the stirrup 30, the user 100 is able to maximize the extent of the lymphatic system which is activated within the leg 102 and foot 103 during use of the device 10. The height of the stirrup 30 also allows the user 100 to rotate his foot 103 within the stirrup 30 to lymphasize different muscles in the legs 102. The final portion of the wire 35 extends downward from the first intersection 32 to the opposite second intersection 33 forming a second downward arc 35C between the first and second intersections 32 and 33. The second downward arc 35C forms the second half of the lower portion 30B of the stirrup 30. The first and second downward arcs 35A and 35C of the lower portion 30B of the stirrup 30 are spaced apart at the lowest point and converge upward such that the ends of the first and second downward arcs 35A and 35C meet at the first and second intersections 32 and 33. The first and second downward arcs 35A and 35C of the lower portion 30B are spaced in order to provide a wider purchase for the user's heel 103A during use of the device 10. In the preferred embodiment, the lower portion 30B of the stirrup 30 is surrounded by padding 38 which is enclosed in a cover 40 (FIG. 2). The padding 38 and cover 40 are used to cushion a user's heel 103A to make use of the device more comfortable. In the preferred embodiment, the cover 40 is constructed of a vinyl material and the padding 38 consists of a sponge rubber sheet double wrapped around the spaced apart section of the lower portion 30B of the first stirrup 30 (FIG. 2). Although the above mentioned padding 38 and cover 40 are preferred, any other variety of size or type of cover 40 or padding 38 could be used.

IN USE

Figure 3:
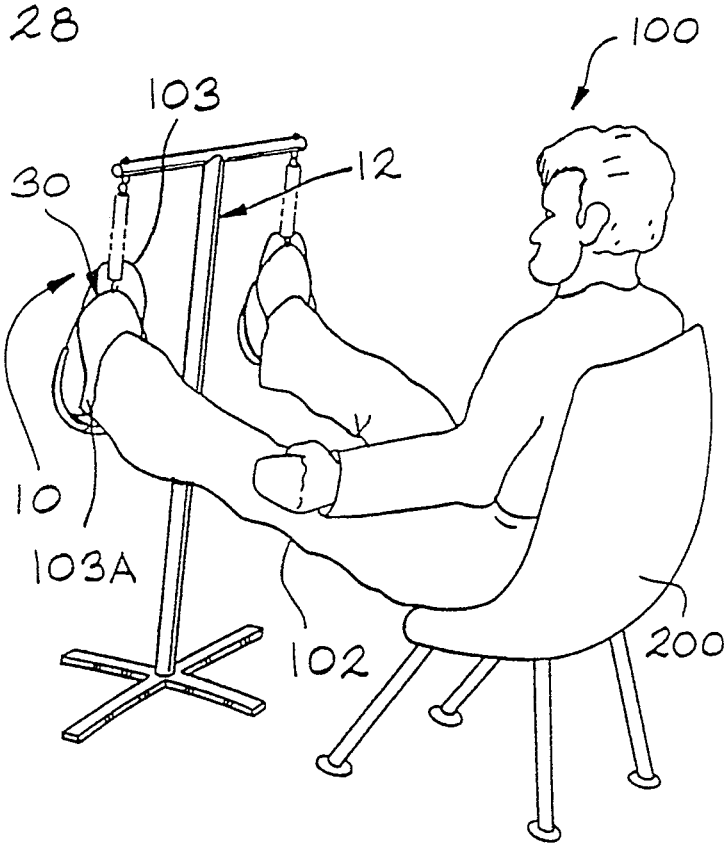
FIG. 3 is a perspective view of the lymphatic system activation device 10 with a user 100 positioned in a chair 200.

The lymphatic system stimulation device 10 of the present invention is intended to be used by a person 100 who is preferably in the sitting position to activate the lymphatic system (FIG. 3). The device is first assembled by attaching the first crossbar 18A and the second crossbar 18B of the base 18 together. Next, the hook bolts 20 and 22 with the coil springs 26 and 28 and the stirrups 30 and 31 attached is mounted to the cross shaft 16. It is understood that the device 10 is disassembled to reduce storage space and to simplify shipping and that it is not necessary to disassemble the device 10 after each use. The user 100 sits in a chair 200 and positions the device 10 directly in front of him. The lymphatic system stimulation device 10 should be spaced away from the chair 200 with the cross shaft 16 of the T-shaped support 12 positioned from left to right with respect to the user 100. The distance of the device 10 from the chair 200 is determined by the length of the user's legs 102. Once the user 100 is comfortably positioned in the chair 200, the device 10 should be spaced away from the user 100 such that when correctly inserted only the heel 103A of the foot 103 rests comfortably on the cover 40 of the stirrups 30 and 31 (FIG. 3). By inserting only the heel 103A into the stirrups 30 and 31, the user 100 can exert less force to operate the device 10 and also does not significantly interfere with a portion of the lymphatic system. Thus, the user 100 achieves the maximum benefit with the least amount of effort.

Once the user 100 is in position with his heels 103A resting in the stirrups 30 and 31, the user 100 exerts a momentary downward force on each of the stirrups 30 and 31 causing the coil springs 26 and 28 to become stretched. The coil springs 26 and 28 will then react by contracting and pulling the user's legs 102 upward. The coil springs 26 and 28 will momentarily continue to oscillate up and down parallel to the axis A—A until all the energy in the coil springs 26 and 28, caused by the initial downward force, has been spent at which time the coil springs 26 and 28 will settle into their original extended position. Due to the necessary weakness of the coil springs 26 and 28, any resulting oscillation will be minimal. Once the coil springs 26 and 28 stop oscillating, the user 100 can exert another downward force to begin the oscillation once again. For prolonged activation of the lymphatic system, the user 100 applies and releases the downward force on the stirrups 30 and 31 continuously using first one leg and then the other. For example, once the coil springs 26 and 28 have contracted to their fullest extent such as when the oscillation cycle begins its downward motion, the user 100 will apply another downward force to once again energize the coil springs 26 and 28. In order for a user 100 to easily cause the coil springs 26 and 28 to oscillate, the resilience of the coil springs 26 and 28 and the height of the main shaft 14 is directly proportional to the user's strength and the user's weight.

The device 10 can also be used as merely an elevated foot rest. The user 100 again places the heel 103A of his foot 103 into the stirrups 30 and 31. However, he does not exert a downward force to begin the oscillating movement in the stirrups 30 and 31. The user 100 merely sits with the heel 103A of his foot 103, resting comfortably in the stirrups 30 and 31 and exerts no force in any direction. The resilience of the coil springs 26 and 28 keeps the stirrups 30 and 31 elevated opposing the weight of the user's legs 102. The elevation of the user's legs 102 allows the blood in the legs 102 to flow out of the legs 102 thus reducing the swelling in the user's legs. This is particularly useful in reducing the pain and discomfort of varicose veins in the legs.

The height of the main shaft 14 and the length and resilience of each coil spring 26 and 28 are interdependent and correspond to the particular size and strength of the user 100. The coil springs 26 and 28 are chosen such that upon insertion of a heel 103A into each stirrup 30 and 32, the weight of the leg 102 will cause each of the coil springs 26 and 28 to expand. Once the user 100 has inserted a heel 103A into each stirrup 30 and 31 and each coil spring 26 and 28 has come to rest at a new lower expanded position, the height of each stirrup 30 and 31 is such that the user 100 is comfortable in that position and the device 10 is being used as a foot rest. This height is achieved by either varying the height of the main shaft 14 of the T-shaped support 12 or by varying the resilience and length of the coil springs 26 and 28 or both. The user 100 is able to sit comfortably with his heels 103A in the stirrups 30 and 31 without moving. The coil springs 26 and 28 and the T-shaped support 12 are preferably chosen such that upon resting the heels 103A in the stirrups 30 and 31, the coil springs 26 and 28 do not expand such that the stirrups 30 and 31 touch the floor. As shown in FIG. 1, the resilience of the coil springs 26 and 28 allows the coil springs 26 and 28 to be stretched downward a total at rest distance of D1 which is preferably about 10 cm upon insertion of the heels 103A of the foot 103 into the stirrups 30 and 31 without applying any downward force.

The device 10 is also constructed such that the user 100 cannot easily extend the coil springs 26 and 28 so as to touch the base 18 of the T-shaped support 12 and such that during oscillation, the stirrups 30 and 31 do not touch either the base 18 or the cross shaft 16 of the T-shaped support 12. The coil springs 26 and 28 have a resilience such that the weight of the user's legs 102 extends the coil springs 26 and 28 downward and conversely pulls the user's legs 102 upward when the user 100 releases the applied downward force on the coil springs 26 and 28. As shown in FIG. 1, the resilience of the coil springs 26 and 28 allows the stirrups 30 and 31 to move parallel to the axis A—A a total top to bottom distance D2 which is about 40 to 60 cm, preferably about 54 cm or such that the heels 103A, in place in the stirrups 30 and 31, are within a distance D3 of preferably about 5 to 10 cm, of the floor at maximum oscillation. For an average person 5'7" and 160 lbs, with average strength, the height of the main shaft 14 should be at least about 107 cm and the spring should have a length of at least 22 cm with a resiliency of about 20 lbs/inch. On the average, the resilience of the coil springs 26 and 28 should preferably be about 5 to 40 lbs/inch with a resilience in the range of 5 to 10 lbs/inch for children, 10 to 20 lbs/inch for average adults and 25 to 30 lbs/inch for heavier adults. The device can be adjusted to accommodate users 100 of various sizes by telescoping the end 16 of shaft 14. These variations and other variations will be obvious to those skilled in the art.

The minimal force needed to energize the coil springs 26 and 28 and the resilience of the coil springs 26 and 28 allows for a continuous up and down motion of the legs 102 without the user 100 expending a large amount of energy. The up and down movement of the legs 102 maintains the activity level in the legs 102 which in turn activates the lymphatic system such that lymph is absorbed away from the cells in the legs 102 and moved up the lymphatic vessels and ultimately into the subclavian vein wherein the lymph is returned to the circulatory system. By keeping the lymph flowing around and away from the cells, the cells remain healthy and the level of lymph in the spaces between the cells remains normal thus preventing soreness or swelling in the user's legs 102. The device of the present invention has been found to provide relief from poor lymphatic circulation, particularly in the legs 102.

The device of the present invention can also be used as a foot rest. The resilience of the coil springs holds the foot in an elevated position thus, relieving pressure in the user's legs. The heel 103A of the foot 103 of the user 100 can rest comfortably on the stirrups 30 and 31 without the user exerting a force on the stirrups 30 and 31. The user can use the device of Applicant's invention either in a sitting or lying position with the heel 103A of the foot 103 on the padding of the stirrups 30 and 31 and the rest of the foot 103 extending upward within the stirrups 30 and 31. By placing only the heel 103A of the foot 103 in the stirrups 30 and 31, the user 100 significantly reduces the amount of interference with the circulation in the foot caused by the contact of the foot with the stirrups 30 and 31.

It is intended that the foregoing description be only illustrative of the present invention and that the invention be limited only by the hereinafter appended claims.

I claim:

1. A lymphatic system activation device which comprises:

(a) a T-shaped support means having a main shaft defining an axis, with a proximal end and a distal end, a stationary cross shaft mounted at the proximal end of the main shaft perpendicular to the axis having a first end and a second end extending equal distance from the main shaft with a first aperture and a second aperture in the plane parallel to the axis in the first end and the second end spaced equal distance from the main shaft and a base means mounted at the distal end of the main shaft for stabilizing the T-shaped support means;

(b) a pair of mounting means, one mounted through each of the first and second apertures in the cross shaft extending downward parallel to the axis;

(c) a pair of resilient means having a top end and a bottom end with the top end connected to each of the pair of mounting means and extending downward toward the base means parallel to the axis; and (d) a pair of stirrup means having an upper portion and a lower portion with the upper portion connected to the bottom end of each of the pair of resilient means, wherein the stirrup means and resilient means are mounted on the cross shaft at a distance from the main shaft wherein the distance between the upper portion and the lower portion such that a foot of a user in a sitting position can fit into each stirrup with a heel of the foot adjacent the lower portion of the stirrup and wherein the resilience of the resilient means ranges from about 5 to 40 lbs./inch dependent on the physical characteristics of the user to provide an initial position, a stretched downward rest distance upon insertion of the user's heels into the stirrup means without any actively applied force by the user, and a bottom distance position of the stirrup means which is above said base means at maximum stretch of the resilient means whereby during use the user inserts his heels into the stirrup means, applies an initial downward force to the stirrup means to a downward position near said bottom distance position and then allows oscillatory movement of the resilient means between said initial position and said downward position without any resistance to provide oscillatory movement of the user's legs to stimulate the circulation of the user without significant exercise of the muscles of the legs.

2. The lymphatic system activation device of claim 1 wherein the base means includes a first crossbar and a second crossbar having a gap for mounting onto the first crossbar and wherein the first crossbar and the second crossbar are connected at their centers such as to form four ends spaced 90° apart extending outward from the main shaft and angled slightly downward from the plane perpendicular to the axis.

3. The lymphatic system activation device of claim 2 wherein the distal end of the main shaft is mounted onto the first crossbar of the base means.

4. The lymphatic system activation device of claim 3 wherein the second crossbar is mounted onto the first crossbar on the side opposite the main shaft.

5. The lymphatic system activation device of claim 2 wherein the first crossbar is connected to the second crossbar by an attachment means.

6. The lymphatic system activation device of claim 5 wherein the attachment means is a flat headed bolt extending through the second crossbar and into the first crossbar.

7. The lymphatic system activation device of claim 2 wherein the first crossbar and second crossbar can be easily disconnected to facilitate compact shipping.

8. The lymphatic system activation device of claim 2 wherein the second crossbar is comprised of a first end bar and a second end bar.

9. The lymphatic system activation device of claim 8 wherein the first end bar and the second end bar are mounted to a support bar to form the second crossbar.

10. The lymphatic system activation device of claim 9 wherein a gap is located between the first end bar and the second end bar for mounting the first crossbar.

11. The lymphatic system activation device of claim 2 wherein each of the four ends has a length greater than the distance between the main shaft and the first and second aperture such as to provide stability for the main shaft.

12. The lymphatic system activation device of claim 2 wherein the distal end of the main shaft is welded onto the first crossbar of the base means.

13. The lymphatic system activation device of claim 9 wherein the first end bar and the second end bar are welded to the support bar to form the second crossbar.

14. The lymphatic system activation device of claim 3 wherein the main shaft is mounted onto the first crossbar such that the first crossbar is in the same plane as the cross shaft.

* * * * *